United States Patent [19]

Hosoi

[11] Patent Number: 4,869,990

[45] Date of Patent: Sep. 26, 1989

[54] TONER FOR USE IN ELECTROSTATOGRAPHY

[75] Inventor: Noriyuki Hosoi, Fujinomiya, Japan

[73] Assignee: Fuji Photo Film Co., Ltd., Kanagawa, Japan

[21] Appl. No.: 145,536

[22] Filed: Jan. 19, 1988

[30] Foreign Application Priority Data

Jan. 19, 1987 [JP] Japan ..... 62-9480

[51] Int. Cl.[4] ..... G03G 9/16

[52] U.S. Cl. ..... 430/110; 430/137; 430/138

[58] Field of Search ..... 430/138, 115, 110, 137

[56] References Cited

U.S. PATENT DOCUMENTS

| | | | |
|---|---|---|---|
| 4,594,305 | 6/1986 | Vollmann et al. | 430/115 |
| 4,756,991 | 7/1988 | Grubb | 430/110 |
| 4,761,358 | 8/1988 | Hosoi et al. | 430/138 |

*Primary Examiner*—John L. Goodrow

*Attorney, Agent, or Firm*—Jules E. Goldberg

[57] ABSTRACT

An improved electrostatographic toner comprises toner particles which comprise a colorant and a binder, wherein to a surface of said toner particle are attached polymer chains formed by a graft polymerization reaction of a monomer having two or more polymerizable double bonds and a monomer having a charge-control group and a polymerizable double bond.

4 Claims, No Drawings

TONER FOR USE IN ELECTROSTATOGRAPHY

BACKGROUND OF THE INVENTION

1. Field of the invention

The present invention relates to an electrostatographic toner employable for producing a visible image from a latent image in a recording method utilizing electrostatography.

2. Description of prior art

As processes for fixing a toner image in a recording method such as electrostatography, there have been known three fixing processes, that is, a heat fixing process, a solvent fixing process and a pressure fixing process. Recently, the heat fixing process and the pressure fixing process, both using no solvent, are widely used from the viewpoint of prevention of environmental pollution.

In the heat fixing process, a toner comprising a colorant and a binder has been conventionally employed. The same kind of toner is also employed in the pressure fixing process, and utilization of an encapsulated toner (i.e., toner in the form of micro-capsule) is recently proposed in the pressure fixing process.

The encapsulated toner is a toner in the form of micro-capsule prepared by enclosing a core material comprising a colorant such as carbon black and a binder such as a polymer and an oily solvent with a resin shell which is rupturable by application of a pressure, while the conventional toner is a toner comprising a binder and a colorant such as carbon black dispersed therein.

The conventional encapsulated toner and the conventional toner are not necessarily satisfactory in various properties essentially required for toners.

As a developing agent employable for electrostatography, there has been conventionally employed a toner having insulation property on its surface, but recently a toner provided with appropriate positive or negative friction-electrostatic chargeability on the surface has been developed.

The electrostatography comprises the steps of electrostatically charging a toner by rubbing the toner with carrier particles such as iron particles or fur, and causing a latent image to attract the electrostatically charged toner. Accordingly, the toner employable in the electrostatography is required to have positive or negative friction-electrostatic chargeability corresponding to the negative or positive electrostatic charge of the latent image depending on the nature of an apparatus employed.

For providing friction-electrostatic chargeability to the conventional toner, there is generally utilized a method of adding an electrostatic charge modifier to a binder resin in the preparation of a toner to disperse the electrostatic charge modifier inside the toner. As the electrostatic charge modifier, nigrosine is generally used to give positive friction-electrostatic chargeability to the toner and a metal complex dye is generally used to give negative friction-electrostatic chargeability to the toner. These modifiers practically serve as electrostatic charge modifiers only when they exist on the surface of the toner.

In the case of an encapsulated toner, a method of depositing a powdery electrostatic charge modifier such as silica powder on the surface of the encapsulated toner is utilized for the same purpose, because it is difficult to effectively fix the above-mentioned electrostatic charge modifier such as nigrosine or a metal complex dye on the surface of the encapsulated toner.

However, the present inventor has found that in any of the toner containing an electrostatic charge modifier such as nigrosine and the encapsulated toner deposited with an electrostatic charge modifier such as silica powder on its surface, the electrostatic charge modifier easily separates or drops off from the toner when the toner is stored or employed for a long period of time.

In the case that a relatively large amount of the electrostatic charge modifier separates or drops off from the toner, the toner tends to have insufficient developing property to cause unfavorable effect on the characteristics of the resulting visible image such as lowering of sharpness or decrease of optical density.

With respect to the friction-electrostatic chargeability of a toner, Japanese Patent Provisional Publication No. 59(1984)-151159 discloses an invention relating to a toner for developing an electrostatic image which is characterized in that to the surface of the toner are chemically attached charge-control groups.

In more detail, the toner disclosed in the above publication is a toner in which compounds having a charge-control group is chemically bonded to functional groups existing on the surface of the toner particle. The compound, unlike the electrostatic charge modifier deposited on the surface of a conventional toner, is chemically bonded to the surface of the toner so as not to easily separate or drop off from the toner, whereby the resulting toner can be provided with relatively stable friction-electrostatic chargeability. In this method, however, the toner can be hardly improved in other physical properties required for toners, though the toner is improved in friction-electrostatic chargeability owing to the charge-control group chemically bonded to the toner surface. Hence, in order to improve other various properties, other components than the above-mentioned compound should be still employed according to the conventional manner.

A toner is required to be excellent in various properties such as powder flowability and preservation stability as well as the friction-electrostatic chargeability. If any one of those properties is unsatisfactory, a visible image of high quality can be hardly obtained.

In general, those properties largely depend on the characteristics of the toner surface or vicinity thereof, and a variety of improvements of the toner surface have been proposed to enhance those properties. For example, a resin having stable friction-electrostatic chargeability and high hardness is preferably arranged on the surface of toner particles to enhance the powder flowability and durability, while the toner is desired as a whole to have a shock-absorbing property such as flexibility at a satisfactory level.

In the case of an encapsulated toner, a method of forming a double-layered shell around a core material has been developed to improve the surface condition of the encapsulated toner. In this method of forming a double-layered shell, however, the resulting encapsulated toner cannot be effectively provided with the friction-electrostatic chargeability, although the toner can be improved in the flowability, etc. For this reason, the surface of the encapsulated toner is generally deposited with an electrostatic charge modifier such as silica powder to improve the friction-electrostatic chargeability.

Otherwise, a method of coating a condensation polymer such as a styrene polymer on the surface of a toner through condensation polymerization in the presence of benzoyl peroxide has been proposed, as described in Japanese Patent Provisional Publication No. 57(1982)-168254. However, it has been confirmed by the present inventor that the friction-electrostatic chargeability cannot be sufficiently given to the toner even in the case of utilizing the method.

SUMMARY OF THE INVENTION

It is an object of the present invention to provide a novel toner employable in electrostatography.

It is another object of the invention to provide a toner employable in electrostatography which is improved in the stability of friction-electrostatic chargeability and shows high powder flowability and high preservation stability.

There is provided by the present invention an electrostatographic toner comprising a toner particle which comprises a colorant and a binder, wherein to a surface of said toner particle are attached polymer chains formed by a graft polymerization reaction of a monomer having at least two polymerizable double bonds and a monomer having a charge-control group and a polymerizable double bond.

The above-mentioned electrostatographic toner can be readily prepared by the process of graft-polymerizing a monomer having two or more polymerizable double bonds and a monomer having a charge-control group and a polymerizable double bond in the presence of a catalyst such as a tetravalent cerium-containing compound to form a polymer chain and bonding the polymer chain to the surface of a toner particle comprising a colorant and a binder.

In the electrostatographic toner of the invention, to the surface of the toner particle are fixed polymer main chains at one end in such a manner that the main chain is protruded from the surface, and the polymer main chain is attached by graft-polymerized polymers (polymer side chains) having an electrostatic charge-modifying function, so that the polymer having the electrostatic charge-modifying function hardly separates or drops off from the toner and gives less variation of the friction-electrostatic chargeability even if the toner is employed for a long period of time, as compared with the conventional toner only deposited with an electrostatic charge modifier such as nigrosine, a metal complex dye or silica powder on its surface. Accordingly, an excellent visible image can be constantly obtained by using the toner of the invention. Further, since the toner of the invention has high powder flowability, the obtained visible image (toner image) shows high sharpness. Moreover, owing to the high preservation stability, the resulting visible image hardly varies in the density even after the longterm storage of the toner.

DETAILED DESCRIPTION OF THE INVENTION

The present invention can be applied to an encapsulated toner or a toner of other known form (i.e., nonencapsulated form). Particularly, the invention is very useful for the encapsulated toner in which effective provision of an electrostatic charge modifier is relatively difficult.

The encapsulated toner will be described in detail hereinafter.

The encapsulated toner can be generally prepared by the following process.

In the first place, a micro-capsule is produced in the conventional manner using known materials which are generally used for the preparation of micro-capsules.

That is, a resin shell which is rupturable by application of a pressure is formed around a core material containing a colorant and a binder such as a polymer and an oily solvent. This process for the preparation of micro-capsules is already known as described above.

In the preparation of an encapsulated toner, a resin shell is formed around an oily core material dispersed in an aqueous medium by means of an interfacial polymerization process or an outer polymerization process, particularly a process based on an in-situ polymerization reaction, to produce a micro-capsule, and thus produced micro-capsule is then washed with water.

Examples of polymers employable as the binder of the encapsulated toner of the invention include polyolefin, olefin copolymer, styrene resin, styrene-butadiene copolymer, epoxy resin, polyester, rubbers, polyvinylpyrrolidone, polyamide, coumarone-indene copolymer, methyl vinyl ether-maleic anhydride copolymer, amino resin, polyurethane, polyurea, homopolymers and copolymers of acrylic acid ester, homopolymers or copolymers of methacrylic acid ester, acrylic acid-long chain alkyl methacrylate copolymer oligomer, polyvinyl acetate, and polyinyl chloride. Among these polymers, preferably employed are homopolymers and copolymers of acrylic acid esters, homopolymers or copolymers of methacrylic esters and styreen-butadiene copolymers.

The oily solvent employable for dissolving the binder therein is, for example, a high-boiling solvent capable of dissolving or swelling the above-mentioned polymers and having a boiling point of not lower than 150° C. (referred to herein as "high-boiling solvent").

Examples of the high-boiling solvents include phthalic acid esters such as diethyl phthalate, and dibutyl phthalate; aliphatic dicarboxylic acid esters such as diethyl malonate and dimethyl oxalate; phosphoric acid esters such as tricresyl phosphate and trixylyl phosphate; citric acid esters such as o-acetyl triethyl citrate and tributyl citrate; benzoic acid esters such as butyl benzoate and hexyl benzoate; aliphatic acid esters such as hexadecyl myristate and dioctyl adipate; alkylnaphathalenes such as methylnaphthalene, dimethylnaphthalene, monoisopropylnaphthalene and diisopropylnaphthalene; alkyldiphenyl ethers such as o-methyldiphenyl ether, m-methyldiphenyl ether and p-methyldiphenyl ether; amides of higher fatty acids or aromatic sulfonic acids such as N,N-dimethyllauroamide and N-butylbenzenesulfonamide; trimellitic acid esters such as trioctyl trimellitate; and diarylalkanes such as diarylmethanes (e.g., dimethylphenylphenylmethane) and diarylethanes (e.g., 1-phenyl-1-methylphenylethane, 1-dimethylphenyl-1-phenylethane and 1-ethylphenyl-1-phenylethane).

The above-mentioned high-boiling solvent can be employed in combination with an organic solvent substantially not dissolving or swelling the above-described polymers and having a boiling point in the range of 100 to 250° C. (referred to herein as "low-boiling solvent"). Examples of the low-boiling solvents include saturated aliphatic hydrocarbons and organic liquid mixtures mainly containing saturated aliphatic hydrocarbons.

The binder of the encapsulated toner of the invention preferably is an oily composition comprising the above-mentioned polymer, low-boiling solvent and the high-boiling solvent in combination.

As a colorant contained in a conventional toner for the electrostatography, generally employed are a black toner such as carbon black or graft carbon black and a chromatic toner such as a blue, red or a yellow colorant. In the encapsulated toner of the invention, those colorants can be also employed.

The core material of the encapsulated toner may further contain magnetizable particles. As the magnetizable particles, there can be mentioned magnetizable particles (particulate material capable of being magnetized) employable for a conventional magnetic toner. Examples of the magnetizable particles include particles of metals (e.g., cobalt, iron and nickel), alloys and metallic compounds. In the case of using a chromatic magnetizable powder such as a powder of black magnetite, the chromatic magnetizable powder can serve as both of a magnetizable particle and a colorant.

There is no specific limitation on the resin employable for producing a shell of the encapsulated toner. From the viewpoint of various properties required for an encapsulated toner, preferred are polyurea, polyurethane, polyamide, polyester and an epoxy resin. These resins can be employed singly or in combination. The resin for producing a shell of the encapsulated toner is preferably employed in combination with a viscosity-reducing agent such as silicone oil.

The process for the preparation of the encapsulated toner will be described below by referring to a process for the preparation of an encapsulated toner comprising a shell of polyurethane resin or polyurea resin.

There have been heretofore known various methods for producing micro-capsules by forming a shell of polyurea and/or polyurethane resin around a core material in the form of an oily droplet containing a colorant and a binder (and magnetizable particles, if desired) in an aqueous medium. Those methods can be employed for the preparation of the encapsulated toner of the invention.

For example, an interfacial polymerization can be mentioned as a method of utilizing polymerization reaction for producing micro-capsules. Other methods such as inner polymerization and outer polymerization, both of which also utilize the polymerization reaction for the preparation of micro-capsules, can be employed in the invention.

A shell of polyurea resin and/or polyurethane resin is easily prepared as a shell of micro-capsules by subjecting a polyisocyanate (e.g., diisocyanate, triisocyanate, tetraisocyanate or polyisocyanate prepolymer) to an interfacial polymerization reaction with a polyamine (e.g., diamine, triamine or tetraamine), prepolymer having two or more amine groups, piperazine or derivatives thereof, or polyol in an aqueous medium.

A shell containing a polyamide resin in addition to a polyurea resin and/or a polyurethane resin such as a shell of polyurea resin and polyamide resin, a shell of polyurethane resin and polyamide resin or a shell of polyurea resin, polyurethane resin and polyamide resin can be prepared according to the following process.

For example, a shell comprising a polyurea resin, a polyurethane resin and a polyamide resin can be prepared by subjecting a polyisocyanate, an acid chloride, a polyamine and a polyol to interfacial polymerization comprising the steps of adjusting pH of the emulsion medium to produce a reaction liquid, and heating the reaction liquid. Otherwise, a shell of a polyurea resin and a polyamide resin can be prepared by subjecting a polyisocyanate, an acid chloride and a polyamine to interfacial polymerization. Those processes for the preparation of a shell of polyurea resin and polyamide resin and a shell of polyurethane resin and polyamide resin are described in detail in Japanese Patent Provisional Publication No. 58(1983)-66948.

The monomer participating in the polymerization reaction for forming the resin shell varies depending on the nature of the employed resin, but generally two or more kinds of monomers are used in combination. Examples of such combinations include a combination of at least one of bifunctional compounds containing a group selected from the group consisting of an isocyanate group, a thioisocyanate group, a bischloroformate group, an acid chloride group and a sulfonyl chloride group and at least one compound selected from the group consisting of water, a polyamine, a polyhydric alcohol, a polythiol and a polyvalent carboxylic acid.

The micro-capsule having a shell is then washed with water.

The method of preparing a conventional toner which is not the encapsulated form (i.e., a toner of nonencapsulated form) is also known, and the toner of nonencapsulated form according to the invention can be also prepared by the known method.

Examples of the binder employable for the toner of non-encapsulated form include a homopolymer of styrene, a homopolymer of a styrene derivative, a styrene copolymer and resins conventionally used for binders. They can be employed independently or in combination.

A colorant employable for the toner of non-encapsulated form according to the invention can be selected from those used in the above-mentioned encapsulated toner.

The surface of the toner particle of the encapsulated toner or the toner of non-encapsulated form prepared as above is then bonded with polymer chains by subjecting a monomer having two or more polymerizable double bonds and a monomer having a charge-control group and a polymerizable double bond in combination to a graft polymerization reaction in the presence of a catalyst. The catalyst employed in the graft polymerization preferably is a compound containing tetravalent cerium.

A method of producing a polymer chain and bonding the polymer chain to a surface of a nylon capsule through a graft polymerization reaction of a polyacrylic acid, etc. in an aqueous medium in the presence of tetravalent cerium ion is described, for example, in a study report on "Control of Film-Permeability Using Surface Grafted Capsule Film" of "Polymer Preprints, Japan", Vol. 33, No. 7, PP. 1859, 1984.

The toner of the invention can be graft-polymerized with a polymer chain utilizing the method described in the above-mentioned report. It is understood that the polymer chain formed on the surface of the toner particle substantially has the similar shape to that described in the report.

In the preparation of the toner of the invention, the encapsulated toner particles or non-encapsulated toner particles prepared as above are in the first place dispersed in an aqueous medium to prepare a dispersion.

To the dispersion are then added a monomer having two or more polymerizable double bonds, a monomer having a charge-control group and a polymerizable double bond and a tetravalent cerium compound to preform a graft polymerization reaction on the surface of the toner particle. As a medium for the aqueous dispersion, water is generally used.

Examples of the tetravalent cerium compounds include cerium ammonium sulfate and cerium ammonium nitrate.

Tetravalent cerium compound is employed generally in an amount of 0.05 to 0.005 lol, preferably 0.05 to 0.01 mol, per 1 mol of the total amount of the monomer having two or more polymerizable double bonds and a monomer having a charge-control group and a polymerizable double bond.

In the graft polymerization reaction of the monomer having two or more polymerizable double bonds and the monomer having a charge-control group and a polymerizable double bond on the surface of the toner particle in the presence of the tetravalent cerium compound, a heating procedure is not always necessary. Accordingly, the polymerization reaction can be performed at room temperature or under heating. The reaction time is generally in the range of 0.1 to 5 hours.

The graft polymerization reaction is preferably carried out in the presence of a dilute nitric acid to enhance the stability of the tetravalent cerium compound.

Examples of the monomers having two or more polymerizable double bonds are as follows:

polyacrylate or polymethacrylate of polyhydric alcohol such as ethyleneglycol diacrylate, diethyleneglycol dimethacrylate, polyethyleneglycol diacrylate, trimethylolpropane triacrylate, trimethylolpropane trimethacrylate, pentaerythritol dimethacrylate, pentaerythritol tetraacrylate, pentaerythritol dimethacrylate, dipentaerythritol pentacrylate, glycerol triacrylate, diglycerol dimethacrylate, 1,3-propanediol diacrylate, 1,2,4-butanetriol trimethacrylate, 1,4-cyclohexanediol diacrylate, 1,5-pentandiol diacrylate, neopentylglycol diacrylate, and triacrylic acid ester of trimethylolpropane added with ethylene oxide;

reaction produce of acrylic acid and amine which has two or more acrylic groups and reaction product of methacrylic acid and amine which has two or more methacrylic groups such as reaction product of acrylic acid or methacrylic acid and ethylenediamine, diaminopropane, pentamethylenediamine, bis(2-aminopropane)amine, diethylenetriamine, phenylenediamine, xylenediamine, diaminotoluene, diaminoanthraquinone, or β-(4-aminophenyl)ethylamine;

polyvinyl ether of polyhydric alcohol such as ethyleneglycol divinyl ether, 1,3,5-tri-β-vinyloxyethoxybenzene, 1,3-di-β-vinyloxyethoxybenzene, and glycerol trivinyl ether;

Polyvinyl ester of polyvalent carboxylic acid such as divinyl succinate, divinyl adipate, divinyl phthalate, divinyl terephthalate, divinylbenzene-1,3-disulfonate, and divinylbutane-1,4-disulfonate; and aromatic compound having two or more vinyl groups such as divinylbenzene, p-allylstyrene, and p-isopropenylstyrene.

Also employable is a compound having two or more unsaturated additive polymerizable bonds different from each other such as N-β-hydroxyethyl-β-(methacrylamide)ethylacrylate, N,N-bis(β-methacryloxyethyl)acrylamide and allylmethacrylate. A polyfunctional urethane compound having at least two unsaturated ethylene groups can be also employed.

The monomer having a charge-control group and a polymerizable double bond preferably is a compound containing a substituent group or a substituent atom (both are referred to as "substituent" hereinafter, unless otherwise specified) which has a Hammett substituent constant (δ) in a specific range, from the viewpoint of provision of satisfactory friction-electrostatic chargeability to the resulting toner. That is, a compound having a reactive double bond which has a substituent having a Hammett substituent constant of not less than 0.4 or a substituent having a Hammett substituent constant of not more than 0 at any of meta and para positions is generally employed.

By subjecting a compound having a substituent which has a Hammett substituent constant (δ) of not less than 0.4 and a reactive double bond to graft polymerization on the surface of toner particles, a toner having negative friction-electrostatic chargeability can be prepared. Using thus prepared toner, an electrostatic image which is positively charged can be developed. The group having a Hammett substituent constant of not less than 0.4 generally has electron-drawing property. Examples of such substituents include nitro group, carbonyl group, carboxyl group, nitrile group (—CN), fluorine atom and cyano group.

A toner having positive friction-electrostatic chargeability can be prepared by subjecting a compound having a substituent which has a Hammett substituent constant of not more 0 and a reactive double bond to graft polymerization on the surface of toner particle. Using thus prepared toner, an electrostatic image which is negatively charged can be developed. The group having a Hammett substituent constant of not more than 0 generally has electron-donating property. Examples of such substituents include a substituted or unsubstituted amino or hydroxyl group.

Examples of the monomers having a charge-control group and a polymerizable double bond and having a substituent which has a Hammett substituent constant in the above-defined range are as follows:

Example of the compounds having a reactive double bond capable of providing a negative friction-electrostatic chargeability to the resulting toner: (meth)acrylonitrile, (meth)acrylic acid and vnyl fluoride; and example of the compounds having a reactive double bond capable of providing a positive friction-electrostatic chargeability to the resulting toner: methyl methacrylate, vinylcarbazole, vinylpyridine, dimethylaminoethyl methacrylate, diacetoneacrylamide and N-vinylimidazole.

Among the above-described compounds, particularly preferred are acrylonitrile and vinylpyridine from the viewpoint of various properties required for toners.

The polymer chain obtained from the monomer having two or more polymerizable double bonds and the monomer having a charge-control group and a polymerizable double bond is preferably bonded to the toner particle in an amount of 0.05 to 10% by weight, more preferably 0.1 to 2% by weight, based on the whole amount of the toner.

Thus, there can be obtained a toner in which a polymer chain is bonded to the surface of the toner particle through a graft polymerization reaction of a monomer having two or more polymerizable double bonds and a monomer having a charge-control group and a polymerizable double bond in the presence of a catalyst.

The toner of the invention prepared as above is graft-polymerized with polymer principal chains having polymer side chains containing the charge-control group of the surface, so that the polymer having an electrostatic charge modifying function hardly separates or drops off from the toner even when the toner is used for a long period of time and accordingly high friction-electrostatic chargeability can be stably kept for a long period of time. Further, the toner of the invention can provide a visible image less suffering variation of an optical density.

The toner of the invention can be provided with a conventional electrostatic charge modifier (or fluidizing agent) such as silica powder, alumina powder and titania powder on its surface. Provision of such electrostatic charge modifiers is very effective especially when the toner is graft-polymerized with a compound having a substituent which has a Hammett substituent constant in the range of 0 to 0.4. Further, the toner of the invention may contain other electrostatic charge modifier such as nigrosine which is generally contained in the conventional toners.

In order to provide the polymer principal chains on the toner surface in the preparation of the toner of the invention, a tetravalent cerium compound is preferably employed as described before, but other methods such as a method of utilizing a photopolymerization reaction using a photopolymerization initiator can be also employed.

The example and the comparison example of the present invention are given below.

EXAMPLE 1

40 g. of 1-isopropyl-phenyl-2-phenylethane solution containing 20 wt. % of polyisobutylmethacrylate (trade name: Acrybase, MM-2002-2; available from Fujikura Kasei Co., Ltd.) and 10 wt. % of polyisobutylmethacrylate (trade name: Acrybase, MM-2002-1; available from Fujikura Kasei Co., Ltd.) was mixed with 70 g. of magnetite particles (trade name: BL-100, available from Titanium Industry Co., Ltd.) in an automatic mortar, to prepare a dispersion (magnetizable ink).

Separately, in 60 g. of ethyl acetate were dissolved 20 g. of paraffin oil having a boiling point of 170–190° C., 3 g. of dimethylphenylsiloxane (trade name: Silicone KF50, viscosity: 3000 cs, available from Shinetsu Chemical Industry Co. Ltd.), 10 g. of an addition produce of 3 mols of hexamethylenediisocyanate and 1 mol of trimethylolpropane (trade name: Barnoc D-950, available from Dainippon Ink & Chemicals Inc.,) and 10 g. of an addition produce of 3 mols of toluylene diisocyanate and 1 mol of trimethylolpropane (trade name: Barnoc D-750, available from Dainippon Ink & Chemicals Inc.,), to prepare a solution.

The solution and the above-obtained dispersion (magnetizable ink) were mixed together to prepare an oily mixture liquid. The oily mixture liquid was prepared by setting the temperature of the liquid to 25° C.

Independently, to 200 g. of a 4% solution of methyl cellulose (methoxy group substitution degree: 1.8, mean molecular weight: 15,000) was added 0.2 g. of diethylenetriamine, to prepare an aqueous medium. The aqueous medium was cooled to 15° C.

In the aqueous medium was dispersed the above-prepared oily mixture liquid to produce an oil-in-water emulsion containing droplets having average diameter of approx. 12 μm.

The emulsion was continuously stirred, and in approx. 10 minutes after the preparation of the emulsion, 50 g. of a 2.5 wt. % solution of diethylene triamine was dropped little by little in the emulsion. Then, the temperature of the emulsion was gradually raised to 60° C. Keeping the temperature of the emulsion at 60° C., the procedure of removing the organic solvent contained in the emulsion was carried out under stirring the emulsion for 3 hours, to complete the encapsulation.

The obtained micro-capsule dispersion was subjected to centrifugal separation at 5,000 r.p.m. so as to separate the micro-capsules from the aqueous solution containing methyl cellulose. The obtained micro-capsule slurry was dispersed in water to prepare a 30% dispersion. The dispersion was again subjected to centrifugal separation to give a micro-capsule slurry, and the micro-capsule slurry was further subjected to another washing procedure comprising dispersing in water.

To the obtained micro-capsule slurry were successively added 450 g. of water, 12.5 g. of 1-N nitric acid, 1.1 g. (0.006 mol) of ethylene glycol dimethacrylate, 10 g. (0.19 mol) of acrylonitrile and 0.75 g. (0.00125 mol) of cerium ammonium nitrate, and they were stirred at room temperature for 3 hours so as to graft-polymerize ethyleneglycol dimethacrylate and acrylonitrile on the surface of the micro-capsules. Subsequently, the micro-capsule dispersion was subjected 15 times to washing procedures comprising centrifugal separation and dispersing in water, to obtain a slurry containing micro-capsules. The slurry was then dried at 60° C., to obtain a toner in which to the surface of the toner particle was attached trimethylolpropane acrylate polymers having polymer side chains of polyacrylonitrile.

Using the toner obtained as above, a positively charged electrostatic latent image produced by conventional electrostatography was developed through a magnetic blushing method. The obtained visible toner image was then transferred onto an ordinary paper sheet and fixed onto the paper sheet by means of a heat roll.

Thus fixed visible image had high sharpness and no fog. Further, even a visible image of relatively low density written with a pencil was able to be sharply duplicated using the encapsulated toner. Then, the visible image was subjected to a test of continuous duplication of 20,000 times for the evaluation on the durability of the toner. Even after the continuous duplication of 20,000 times, the optical density of a visible image hardly decreased. Further, the continuous duplication test of 30,000 times was carried out on the visible image, and substantial decrease of image density was not observed.

COMPARISON EXAMPLE 1

The procedure of Example 1 was repeated except for not treating with ethylene glycol dimethacrylate and acrylonitrile and adding 2 wt. % of hydrophobic silica (R-976 of Japan Aerozil Co., Ltd.), to prepare an encapsulated toner.

Using the obtained encapsulated toner, a positively charged electrostatic latent image produced by conventional electrostatography was developed through a magnetic blushing method in the same manner as described in Example 1. The obtained visible toner image was then transferred onto an ordinary paper sheet and fixed onto the paper sheet at a pressure of 150 kg/cm$^2$. The visible image was subjected to a test of continuous duplication for evaluation on the durability of the toner. As a result, it was confirmed that the optical density of visible image decreased as the times of the duplication increased.

I claim:

1. An electrostatographic toner prepared by the process of graft polymerizing a monomer having at least two polymerizable double bonds and a monomer having a charge-control group and polymerizable double bond in the presence of toner particles comprising a colorant and a binder so as to attach said graft polymer to the surface of said toner particle.

2. The electrostatographic toner as claimed in claim 1, wherein said toner particle is in the form of microcapsule comprising a core which comprises an oily binder and a colorant and a resin shell enclosing said core.

3. The electrostatographic toner as claimed in claim 1, wherein said monomer having at least two polymerizable double bonds is a compound selected from the group consisting of a polyacrylate of a polyhydric alcohol, a polymerthacrylate of a polyhydric alcohol, a reaction product of acrylic acid and an amine which has at least two acrylic groups, a reaction product of methacrylic acid and an amine which has at least two methacrylic groups, a polyvinyl ether of a polyhydric alcohol, a polyvinyl ester of a polyvalent carboxylic acid and an aromatic compound having at least two vinyl groups.

4. The electrostatographic toner as claimed in claim 1, wherein said monomer having a charge-control group and a polymerizable double bond is a compound having a charge-control group selected from the group consisting of nitro group, carboxyl group, carbonyl group, nitrile group, fluorine atom, cyano group, a substituted or unsubstituted amino group and hydroxyl group, and a polymerizable double bond.

* * * * *